US011596030B2

(12) United States Patent
Gallivanoni et al.

(10) Patent No.: US 11,596,030 B2
(45) Date of Patent: Feb. 28, 2023

(54) SYSTEM AND METHOD FOR IDENTIFYING COOKWARE ITEMS PLACED ON AN INDUCTION COOKTOP

(71) Applicant: WHIRLPOOL CORPORATION, Benton Harbor, MI (US)

(72) Inventors: Andrea Gallivanoni, Casorate Sempione (IT); Cristiano Vito Pastore, Comerio (IT); Federica Inderst, Saronno (IT)

(73) Assignee: Whirlpool Corporation, Benton Harbor, MI (US)

( * ) Notice: Subject to any disclaimer, the term of this patent is extended or adjusted under 35 U.S.C. 154(b) by 350 days.

(21) Appl. No.: 16/946,101

(22) Filed: Jun. 5, 2020

(65) Prior Publication Data

US 2021/0385914 A1 Dec. 9, 2021

(51) Int. Cl.
*H05B 6/06* (2006.01)
*F24C 7/08* (2006.01)

(52) U.S. Cl.
CPC ..... *H05B 6/065* (2013.01); *F24C 7/083* (2013.01); *H05B 2213/03* (2013.01); *H05B 2213/05* (2013.01)

(58) Field of Classification Search
CPC . F24C 7/083; H05B 2213/03; H05B 2213/05; H05B 6/062; H05B 6/065
See application file for complete search history.

(56) References Cited

U.S. PATENT DOCUMENTS

| | | | |
|---|---|---|---|
| 6,614,006 | B2 | 9/2003 | Pastore et al. |
| 6,870,138 | B2 | 3/2005 | Pastore |
| 6,930,287 | B2 | 8/2005 | Gerola et al. |
| 8,742,299 | B2 | 6/2014 | Gouardo et al. |
| 9,204,499 | B2 | 12/2015 | Kim et al. |
| 9,585,200 | B2 | 2/2017 | Christiansen et al. |
| 10,009,960 | B2 | 6/2018 | Lahoz et al. |
| 10,244,584 | B2 | 3/2019 | Fattorini et al. |

FOREIGN PATENT DOCUMENTS

| | | | |
|---|---|---|---|
| EP | 2112865 | A2 | 10/2009 |
| EP | 2445310 | A2 | 4/2012 |
| EP | 2242328 | B1 | 6/2012 |
| EP | 2445305 | B1 | 3/2015 |
| EP | 2034799 | B1 | 5/2015 |
| EP | 2242329 | B1 | 7/2015 |
| EP | 2914060 | A1 | 9/2015 |
| EP | 3307018 | B1 | 3/2019 |

*Primary Examiner* — Brian W Jennison
*Assistant Examiner* — Abigail H Rhue
(74) *Attorney, Agent, or Firm* — Price Heneveld LLP

(57) ABSTRACT

A method for identifying cookware on an induction cooktop having coils, includes the steps: (a) acquire a coverage factor matrix; (b) set a present level at a maximum value of the matrix; (c) count closed iso-level curves corresponding to the present level and save the result; (d) decrease the level by an amount; (e) count closed curves corresponding to the decreased level; (f) when the number of closed curves at the present level is not lower than that from the previous level, update the saved result with the present level; (g) when the number of closed curves at the present level is lower than that from the previous level, keep the previously saved result; (h) repeat steps (d) to (h), until the number decreases; (i) assign coils inside the curve to a distinct cluster; and (j) use the clustering to estimate a position, shape, size, and orientation of the cookware.

25 Claims, 21 Drawing Sheets

FIG. 8
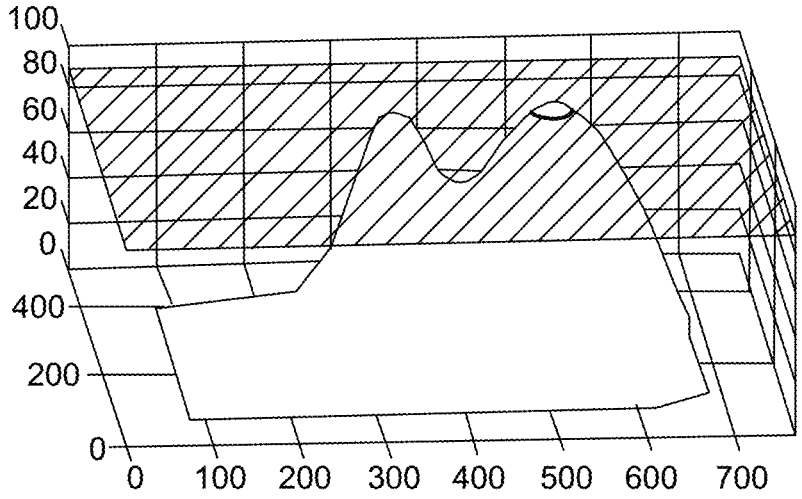
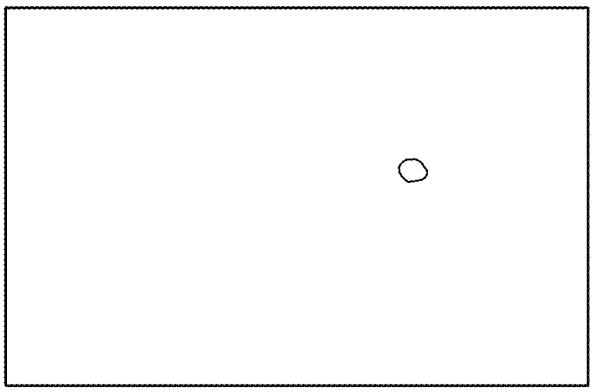
FIG. 8A

FIG. 9
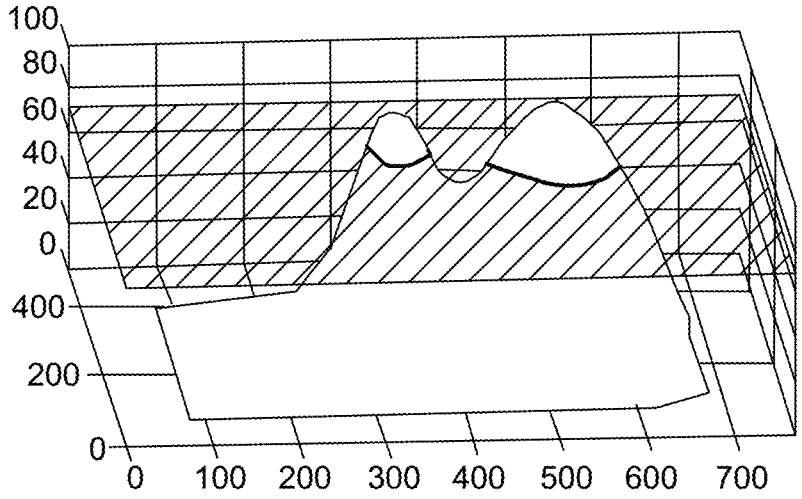
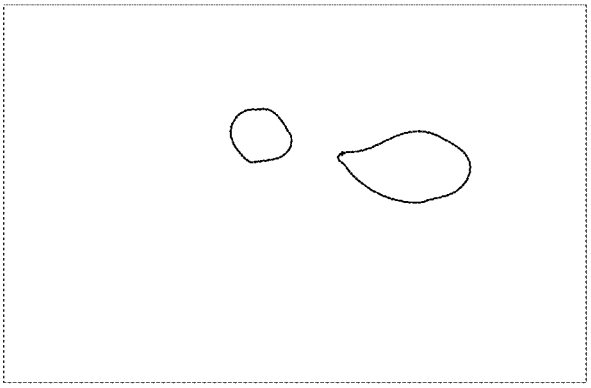
FIG. 9A

FIG. 10
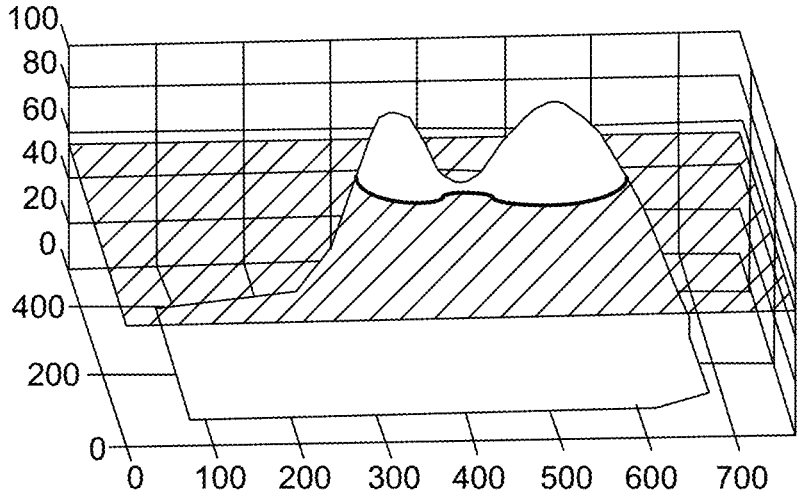
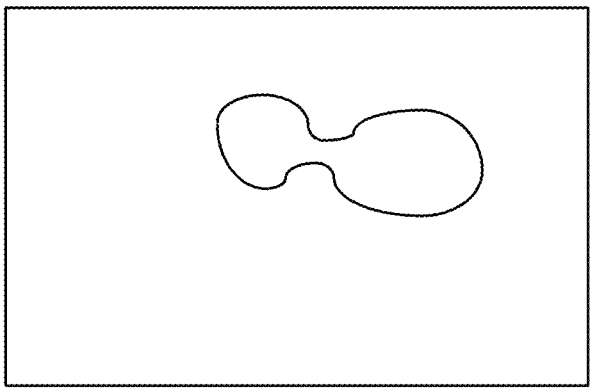
FIG. 10A

FIG. 19
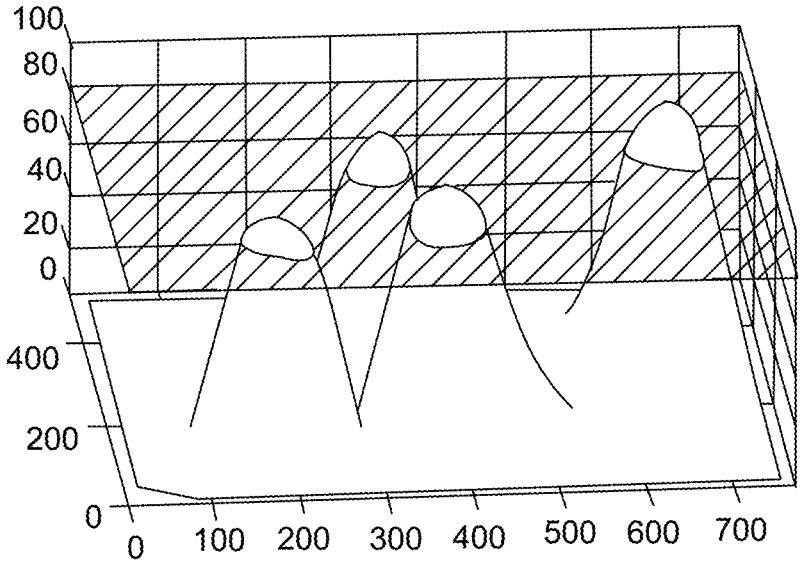
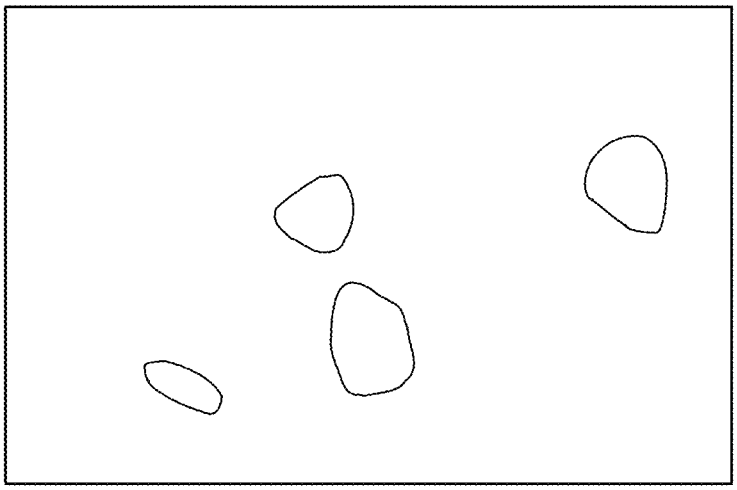
FIG. 19A

SYSTEM AND METHOD FOR IDENTIFYING COOKWARE ITEMS PLACED ON AN INDUCTION COOKTOP

BACKGROUND OF THE DISCLOSURE

The present disclosure generally relates to a system and method for identifying cookware items placed on an induction cooktop.

SUMMARY OF THE DISCLOSURE

According to one aspect of the present disclosure, a method is provided for identifying cookware items placed on top of an induction cooktop having a plurality of coils, comprising the following steps: (a) acquire the coverage factor information for each coil, and collect it into a coverage factor matrix; (b) set a present intercept level at an identified maximum value; (c) calculate iso-level curves corresponding to the present intercept level; (d) count the number of closed iso-level curves calculated in step (c) and save the result; (e) decrease the present intercept level by a predetermined amount; (f) calculate iso-level curves corresponding to the decreased intercept level; (g) count the number of closed iso-level curves calculated in step (f); (h) compare the number of closed curves at the present intercept level with the number of closed curves from the previous intercept level; (i) if the number of closed curves at the present intercept level is the same as or higher than the number of closed curves from the previous intercept level, discard the previously saved result and update with the present intercept level; (j) if the number of closed curves at the present intercept level is lower than the number of closed curves from the previous intercept level, keep the previously saved result and skip to step (l); (k) repeat steps (e) to (k), until the number decreases or the decreased intercept level reaches a predetermined minimum threshold; (l) for each closed curve, determine which coils are inside the curve, and assign those coils to a distinct cluster; and (m) use the identified coil clustering to estimate a position, shape, size, and orientation of the cookware item.

According to another aspect of the present disclosure, an induction cooktop system is provided comprising: an induction cooktop including a plurality of induction coils; a power supply for supplying power to selected ones of the plurality of induction coils; and a controller for identifying cookware items placed on top of the induction cooktop, estimating the position, shape, size, and orientation of the cookware items, and controlling the amount of power supplied to the selected ones of the plurality of induction coils, the controller being programmed to perform at least the following steps: (a) acquire the coverage factor information for each coil, and collect it into a coverage factor matrix; (b) set a present intercept level at the identified maximum value; (c) calculate iso-level curves corresponding to the present intercept level; (d) count the number of closed iso-level curves calculated in step (c) and save the result; (e) decrease the present intercept level by a predetermined amount; (f) calculate iso-level curves corresponding to the decreased intercept level; (g) count the number of closed iso-level curves calculated in step (f); (h) compare the number of closed curves at the present intercept level with the number of closed curves from the previous intercept level; (i) if the number of closed curves at the present intercept level is the same as or higher than the number of closed curves from the previous intercept level, discard the previously saved result and update with the present intercept level; (j) if the number of closed curves at the present intercept level is lower than the number of closed curves from the previous intercept level, keep the previously saved result and skip to step (l); (k) repeat steps (e) to (k), until the number decreases or the decreased intercept level reaches a predetermined minimum threshold; (l) for each closed curve, determine which coils are inside the curve, and assign those coils to a distinct cluster; and (m) use the identified coil clustering to estimate a position, shape, size, and orientation of the cookware item.

According to yet another aspect of the present disclosure, a method is provided for identifying cookware items placed on top of an induction cooktop having a plurality of coils, comprising the following steps: (a) acquire the coverage factor information for each coil, and collect it into a coverage factor matrix; (b) set a present intercept level at a maximum value identified in the input coverage factor matrix; (c) identify and count closed iso-level curves corresponding to the present intercept level and save the result; (d) decrease the present intercept level by a predetermined amount; (e) identify and count closed iso-level curves corresponding to the decreased intercept level; (f) when the number of closed curves at the present intercept level is the same as or higher than the number of closed curves from the previous intercept level, discard the previously saved result and update with the present level; (g) when the number of closed curves at the present intercept level is lower than the number of closed curves from the previous intercept level, keep the previously saved result and skip to step (i); (h) repeat steps (d) to (h), until the number decreases or the decreased intercept level reaches a predetermined minimum threshold; (i) for each closed curve, determine which coils are inside the curve, and assign those coils to a distinct cluster; (j) use the identified coil clustering to estimate a position, shape, size, and orientation of the cookware item; and (k) supply power to the coils underlying the cookware items.

These and other features, advantages, and objects of the present disclosure will be further understood and appreciated by those skilled in the art by reference to the following specification, claims, and appended drawings.

BRIEF DESCRIPTION OF THE DRAWINGS

In the drawings:

FIG. 8 is a 3D coverage factor curve having an intersect plane at a first level;

FIG. 8A is a closed curve determined from the intersect of the 3D coverage factor curve of FIG. 8 by the plane at the first level;

FIG. 9 is a 3D coverage factor curve having an intersect plane at a second level;

FIG. 9A is a group of closed curves determined from the intersect of the 3D coverage factor curve of FIG. 9 by the plane at the second level;

FIG. 10 is a 3D coverage factor curve having an intersect plane at a third level;

FIG. 10A is a closed curve determined from the intersect of the 3D coverage factor curve of FIG. 10 by the plane at the third level;

FIG. 19 is a 3D coverage factor curve having an intersect plane at a first level;

FIG. 19A is a group of closed curves determined from the intersect of the 3D coverage factor curve of FIG. 19 by the plane at the first level.

Figure 1:
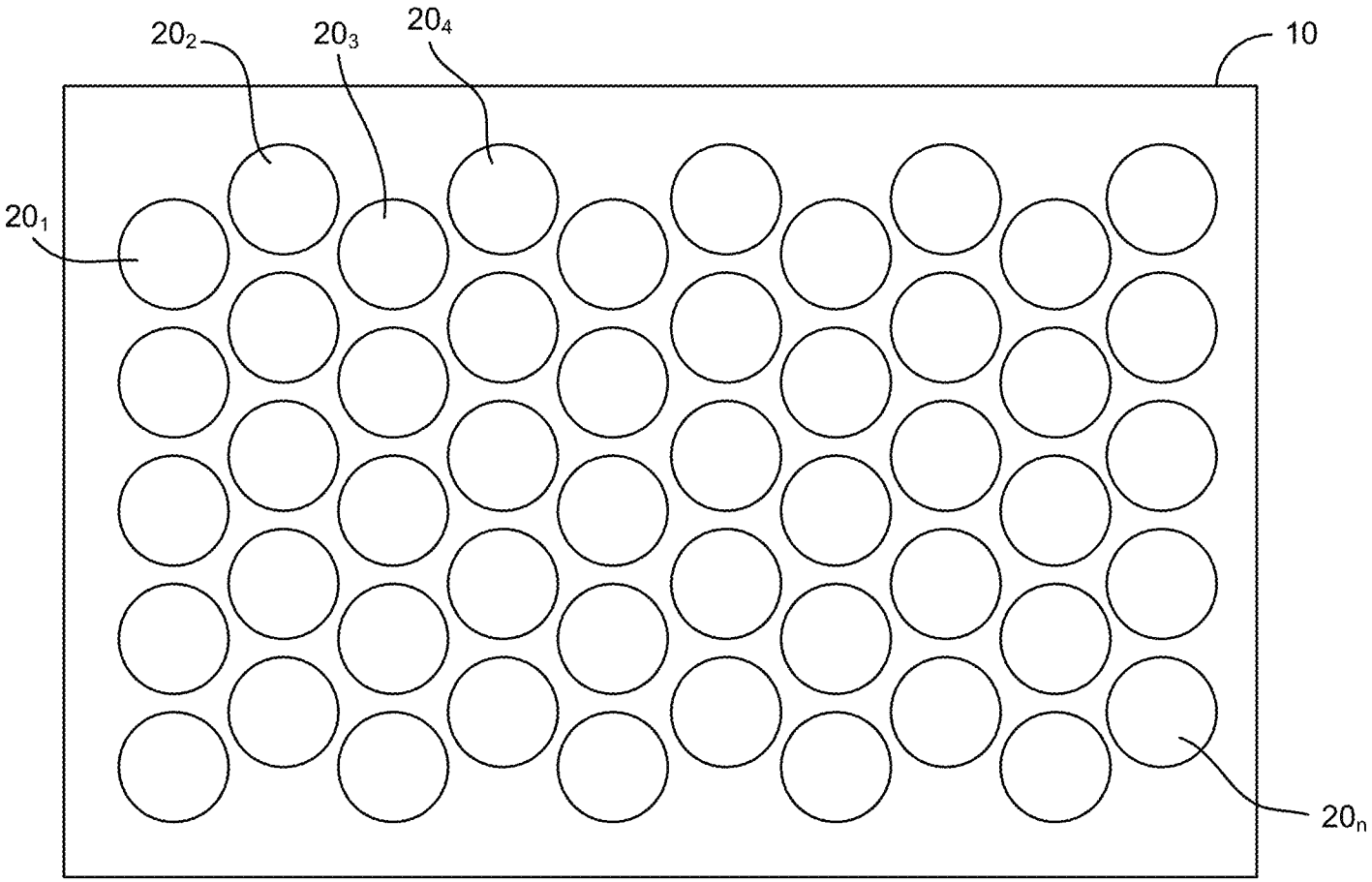
FIG. 1 is a top view of an induction cooktop having an array of coils.

The components in the figures are not necessarily to scale, emphasis instead being placed upon illustrating the principles described herein.

DETAILED DESCRIPTION

The present illustrated embodiments reside primarily in combinations of method steps and apparatus components related to an induction cooktop. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

The method described below aims at determining the position, size, shape, and orientation of a number of cookware items such as pots and/or pans, placed over a flexible induction cooktop. FIG. 1 shows an induction cooktop 10 characterized by having a large number of coils $\mathbf{20}_1$-$\mathbf{20}_n$, whose dimensions are typically smaller than the size of a cookware item, and these coils $\mathbf{20}_1$-$\mathbf{20}_n$ are distributed next to each other to form mono-dimensional or bi-dimensional arrays.

When conventional cookware item detection techniques are applied to each individual coil $\mathbf{20}_1$-$\mathbf{20}_n$, either a discrete YES/NO or a continuous coverage factor information is available for each coil $\mathbf{20}_1$-$\mathbf{20}_n$, but unfortunately this information is not sufficient to determine the number, position, size, shape, and orientation of cookware items laid over the induction cooktop 10.

Regarding conventional pan detection techniques, ES2362839/EP2242328 from Bosch Siemens essentially proposes to generate a first image whose "pixels" are representing the coverage factor in response of the overlying cookware items. Then it proposes to identify a cohesive (i.e. contiguous) area made of neighboring cells having a coverage factor larger than a predetermined threshold. Finally, it is proposed to apply a separation algorithm aimed at differentiating whether the contiguous area corresponds to one cookware item or to multiple cookware items close to each other. The proposed method in ES2362839/EP2242328 is known to provide inaccurate results whenever the heating cell dimension is not sufficiently small compared to the size of the cookware item.

Another relevant prior art reference is EP2034799B1, which proposes to first determine a cell covered by a cookware item and then perform a selective search in a neighborhood of that cell, through a set of additional sensors.

Figure 2A:
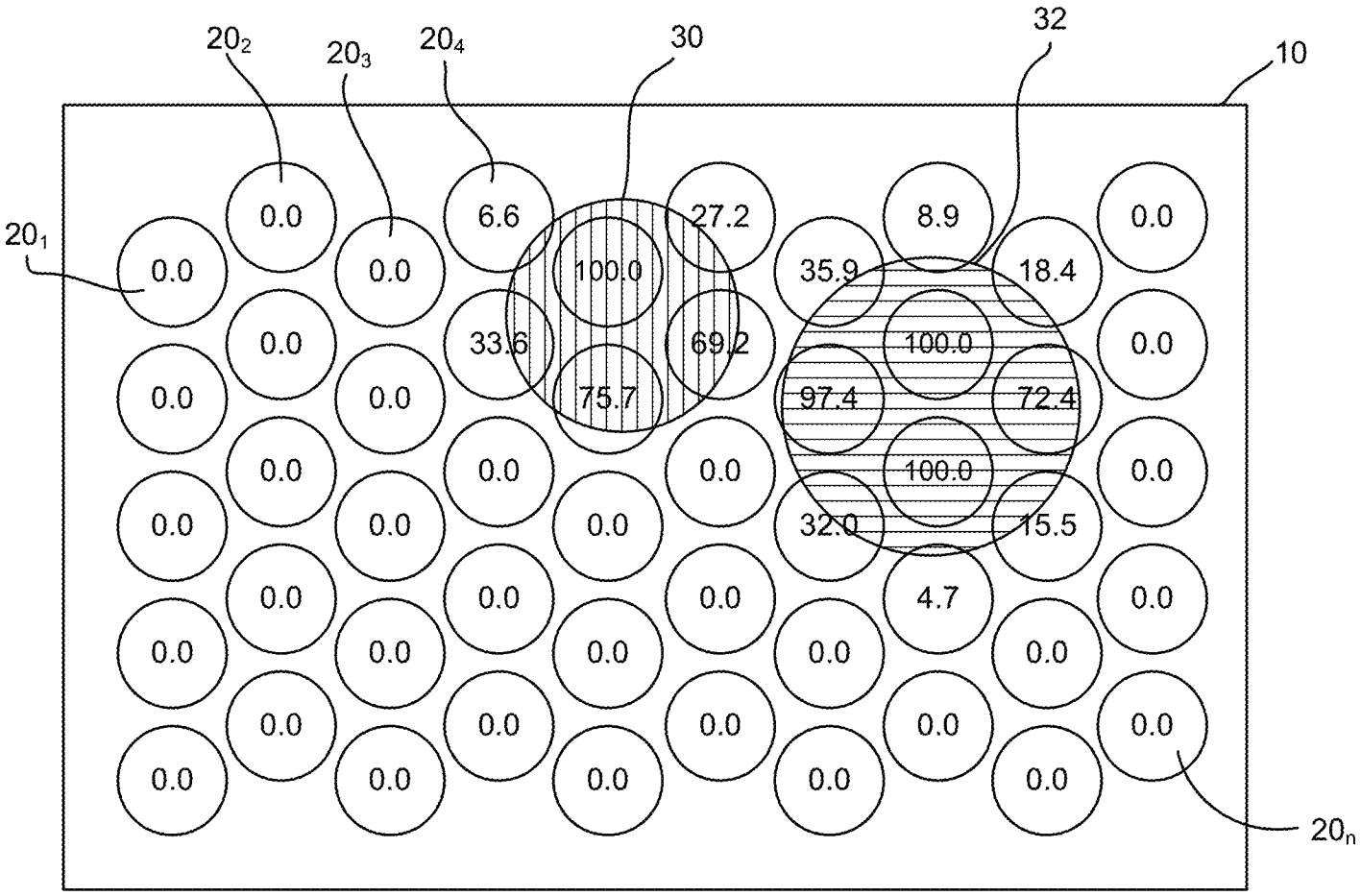
FIG. 2A is a top view of the induction cooktop of FIG. 1 shown with two cookware items thereon with the coverage factors of each coil indicated.
Figure 2B:
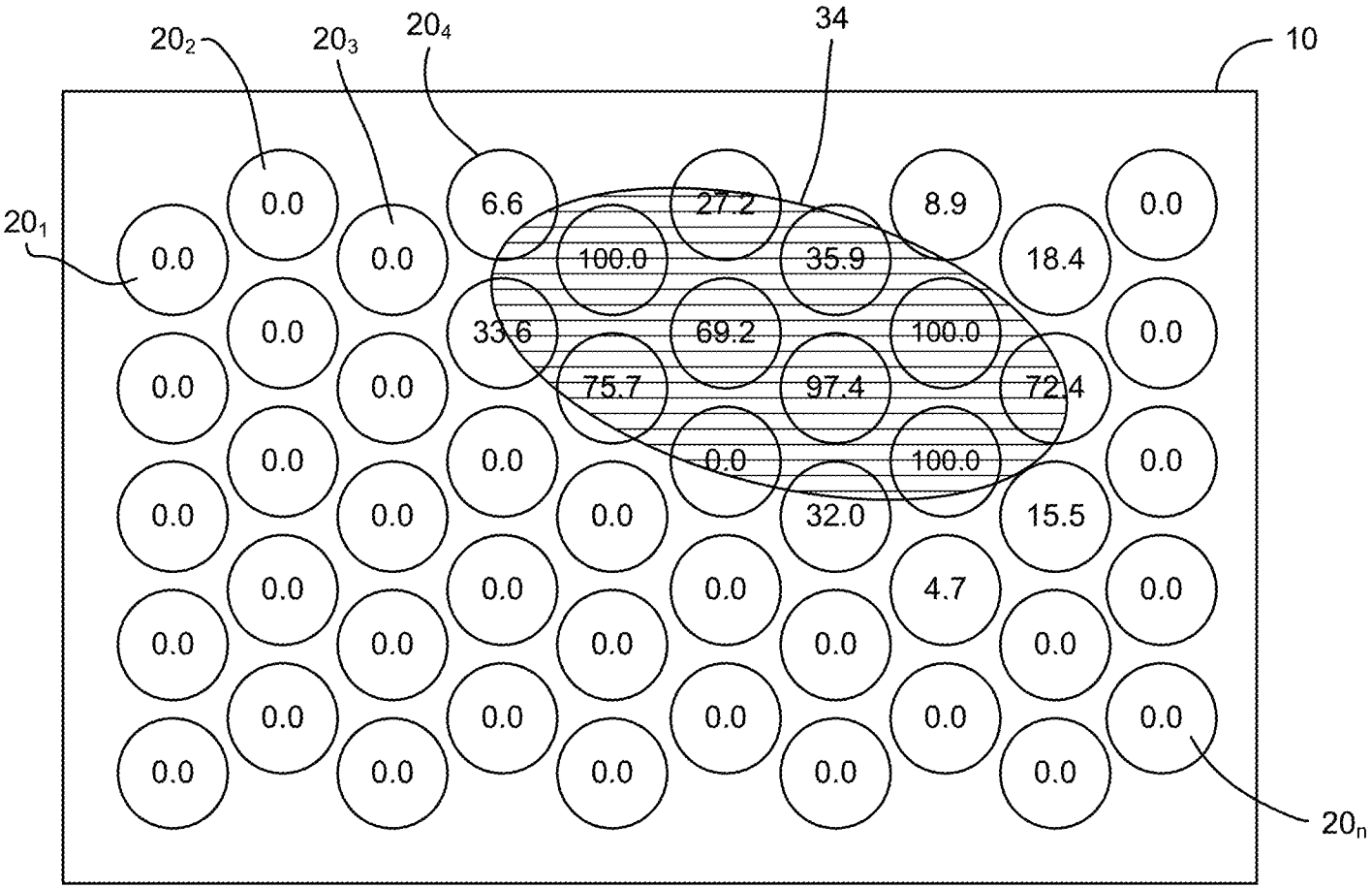
FIG. 2B is a top view of the induction cooktop of FIG. 1 shown with an incorrect estimate of the size, shape, orientation and position of the cookware items shown in FIG. 2A.

FIG. 2A shows actual cookware items 30 and 32 placed on top of a flexible induction cooktop 10. FIG. 2B shows a single elliptical cookware item 34 that is incorrectly identified instead of two circular ones, since the two cookware items 30 and 32 are too close to each other. The number inside each coil $\mathbf{20}_1$-$\mathbf{20}_n$ displays the corresponding coverage factor. In particular cases, when two cookware items 30 and 32 are really close to each other, the set of activated coils $\mathbf{20}_1$-$\mathbf{20}_n$ can be confused with the one activated by a single elliptical cookware item 34. The objective of the present method is to provide a method for cookware item identification and estimation able to identify individual cookware items as distinct items.

Figure 3:
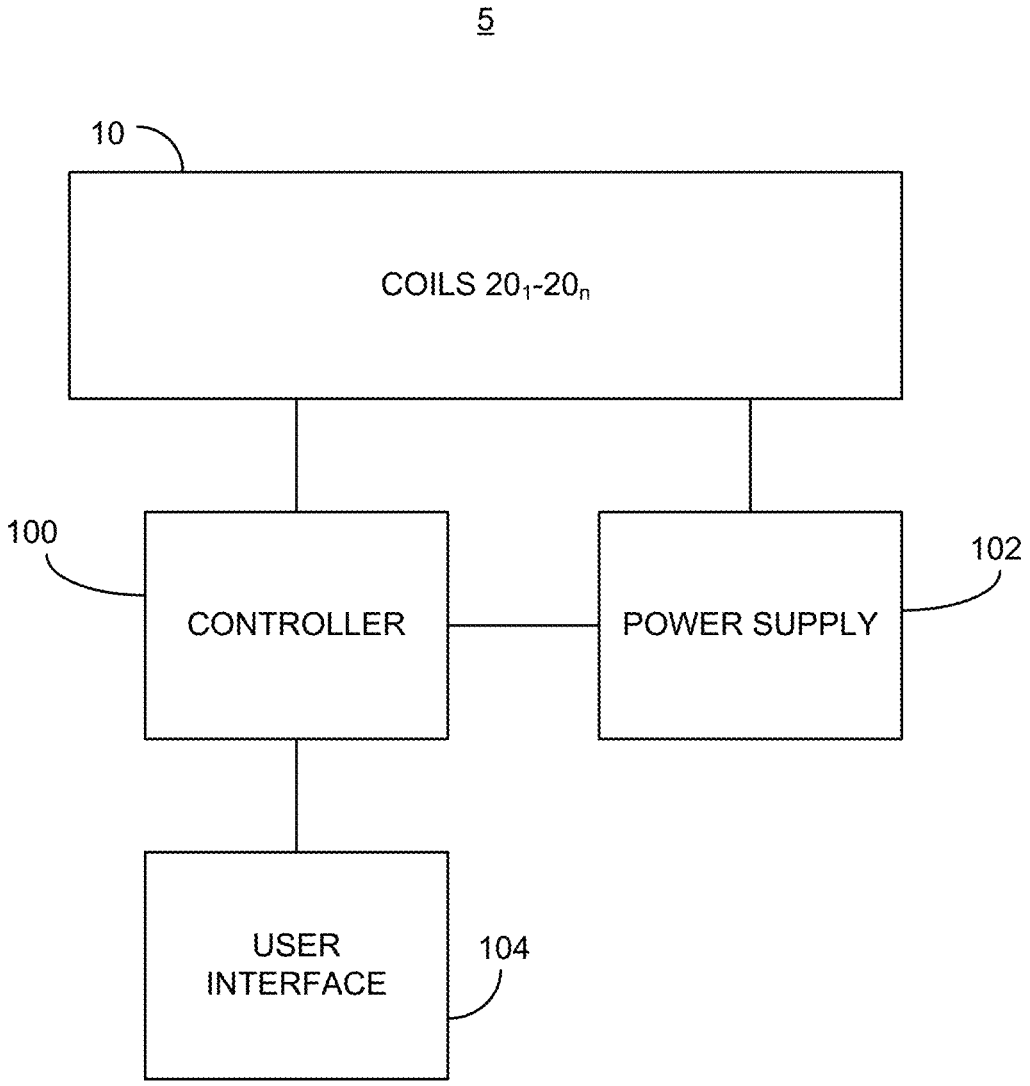
FIG. 3 is an electrical circuit diagram in block form of an induction cooktop system using the induction cooktop of FIG. 1.

FIG. 3 shows a block diagram of the basic electrical components of an induction cooktop system 5. A controller 100, such as a microprocessor or the like, is coupled to each of the coils $\mathbf{20}_1$-$\mathbf{20}_n$ of the induction cooktop 10 and to a power supply 102 and a user interface 104. In general, the controller 100 will respond to activation of an input on the user interface 104 to detect the presence, size, shape, orientation, and position of any cookware items 30 and 32 on the induction cooktop 10 using the method described below. Once the size, shape, orientation, and position of any cookware items 30 and 32 are identified, the controller 100 will control the power supply 102 to supply an appropriate power level to the coils $\mathbf{20}_1$-$\mathbf{20}_n$ underlying the cookware items 30 and 32 in order to heat food in the cookware items 30 and 32.

The user interface 104 may be any conventional user interface and may include various inputs such as temperature settings and timers or the like.

Figure 4:
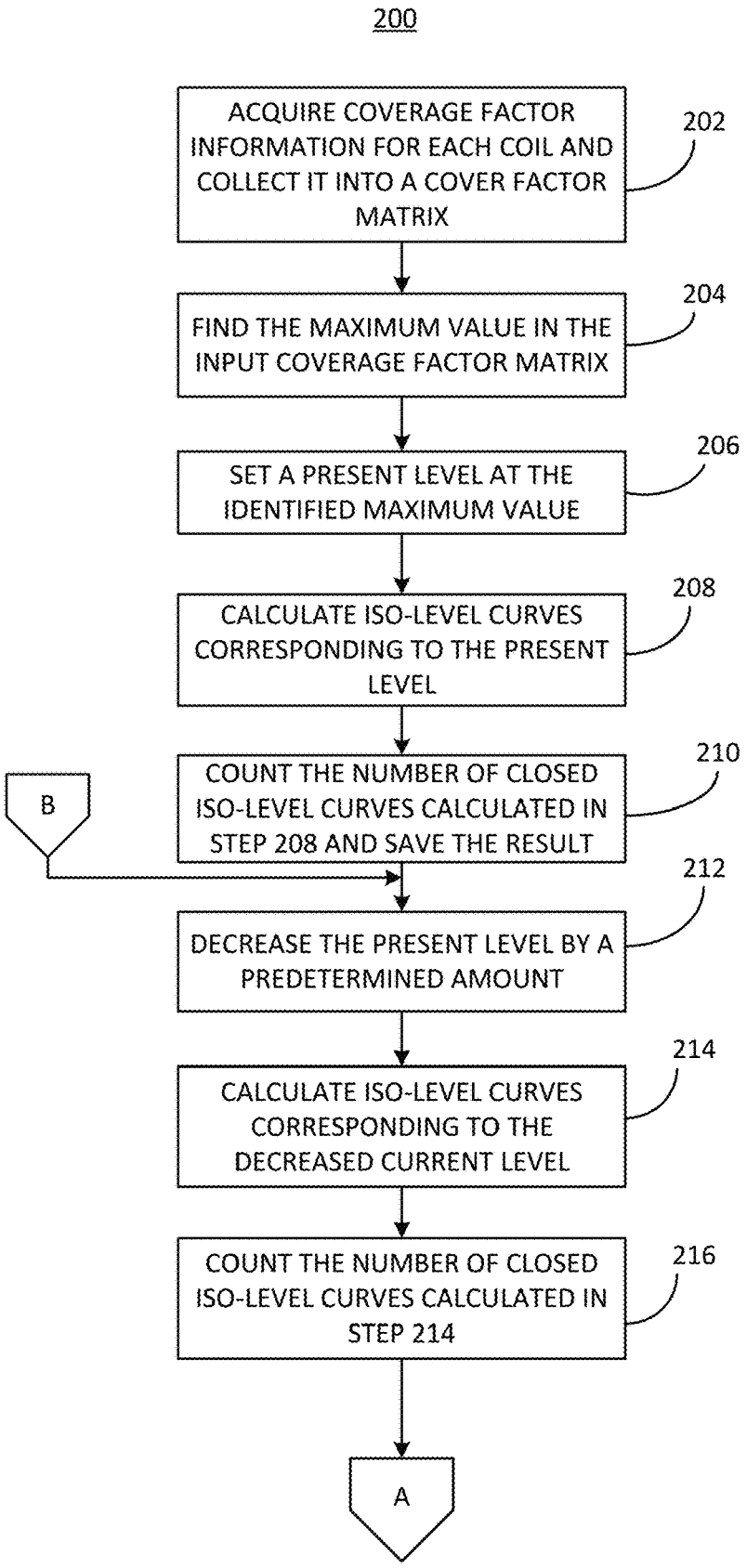
FIGS. 4 and 4A are a flow chart of an algorithm executed by the controller in FIG. 3.
Figure 4A:
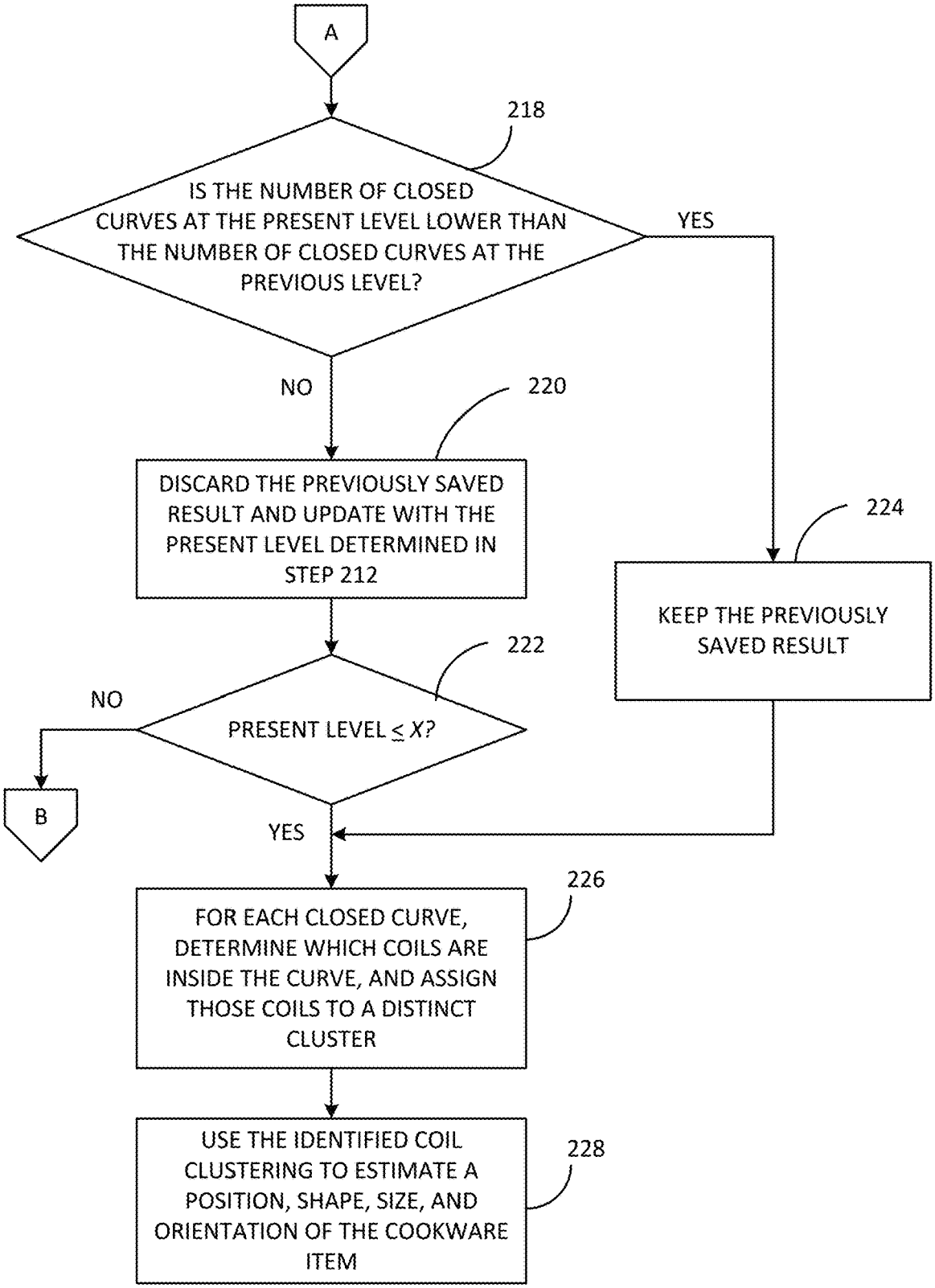

A method 200 described herein is shown in FIGS. 4 and 4A and may be implemented as an algorithm executed by the controller 100. The method 200 has a preliminary step 202 in the acquisition of a matrix of coverage factors, each element of the matrix corresponding to one coil $\mathbf{20}_1$-$\mathbf{20}_n$. The particular manner in which the controller 100 determines the coverage factor of each coil $\mathbf{20}_1$-$\mathbf{20}_n$ is not described herein insofar as any known technique may be used. The coverage factor matrix is then processed according to the described method 200 to identify the different cookware items 30 and 32.

The coverage factor for each coil is defined as the fraction of the area of the coil that is covered by an overlying cookware item. In FIG. 2A and following, this fraction is expressed as a percentage. It is understood that other information related to the coverage factor can be used instead, such as, but not limited to, inductance, resistance, or power factor.

The surface of the cooktop 10 is associated with a coordinate system apt to describe a 2D surface, for example, but not limited to, a Cartesian coordinate system with origin in the lower left corner of the cooktop surface, with the x axis oriented horizontally towards the right and the y axis oriented vertically towards the back.

This method 200 is based on the concept of iso-level curves that goes under different names in different fields. For example, "isohypses" and "contour lines" are common names in cartography and geography to denote elevation or altitude on maps; "isobars" and "isotherms" are common features of maps shown in forecasts to display atmospheric pressure and temperature. Whatever the name, iso-level curves are curves that connect all points on a plane that have the same value of the dependent variable, as a function of position. In the cited examples, the dependent variable is, respectively, altitude, atmospheric pressure, and temperature. For this method, the dependent variable is the coverage factor of each coil $\mathbf{20}_1$-$\mathbf{20}_n$.

The method 200 presupposes that the coverage factor of the coils $\mathbf{20}_1$-$\mathbf{20}_n$ have already been acquired, and therefore takes as input a matrix containing the coverage factors of each individual coil $\mathbf{20}_1$-$\mathbf{20}_n$ in the induction cooktop 10 (step 202).

The iso-level curve calculation is akin to considering a mountainous terrain, where regions with high coverage factors correspond to the peaks, and regions with low coverage factors correspond to the valleys. An imaginary plane, at a predetermined "altitude," corresponding to a predetermined coverage factor level, intersects the 3D surface of the terrain, and all the intersection points are collected to form the iso-level curves. An example is shown in FIG. 5.

Figure 5:
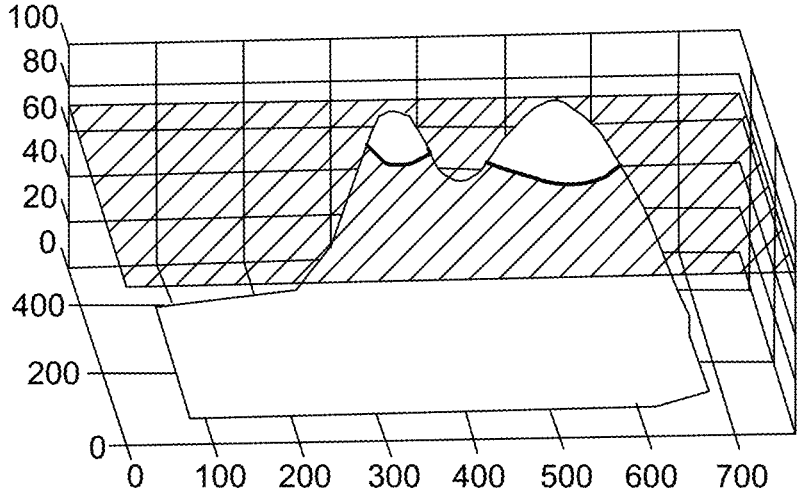
FIG. 5 is a 3D coverage factor curve having an intersect plane at a present level.
Figure 6:
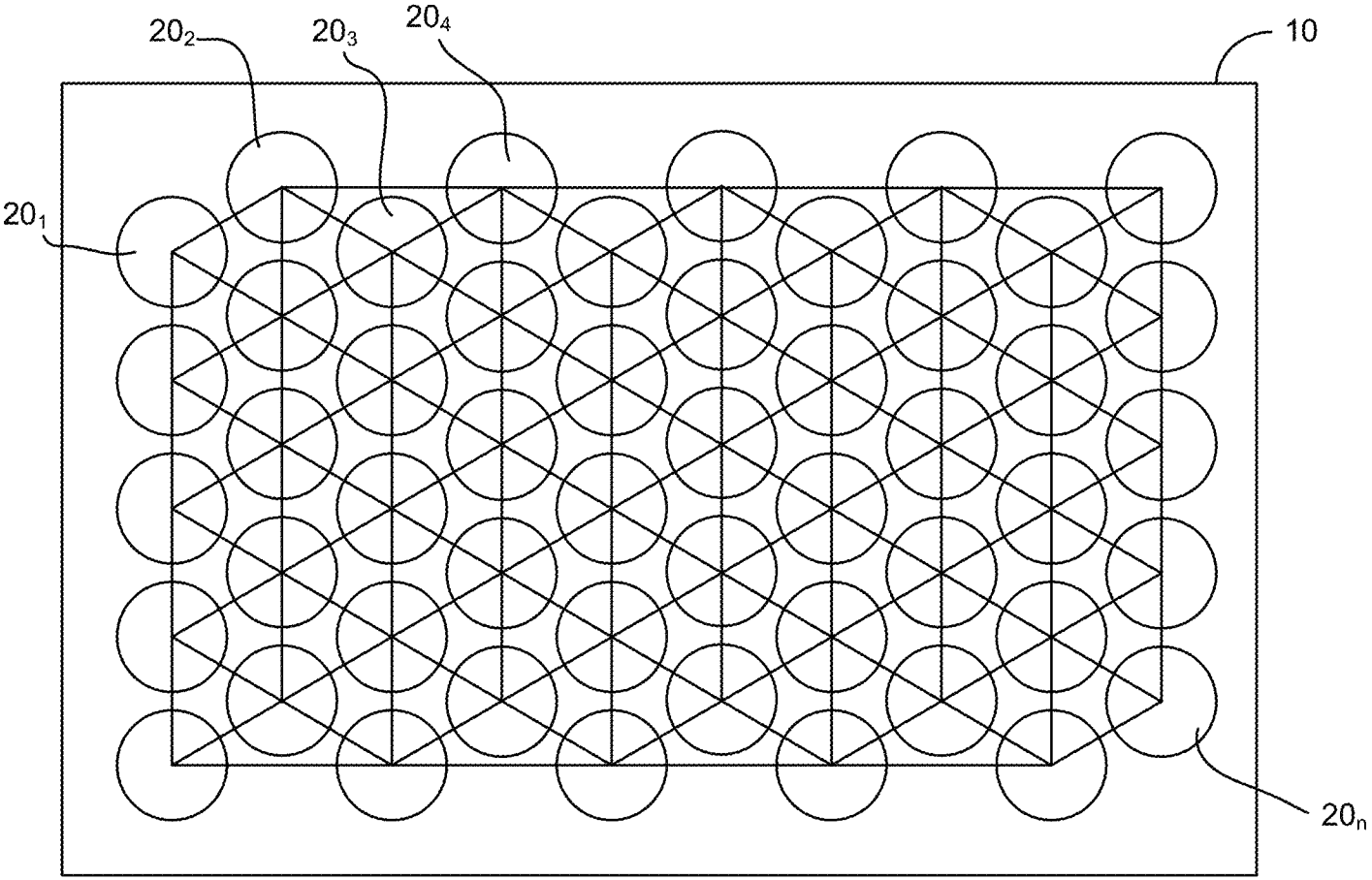
FIG. 6 is a top view of the induction cooktop of FIG. 1 showing a triangular grid that connects the center of adjacent coils.
Figure 7:
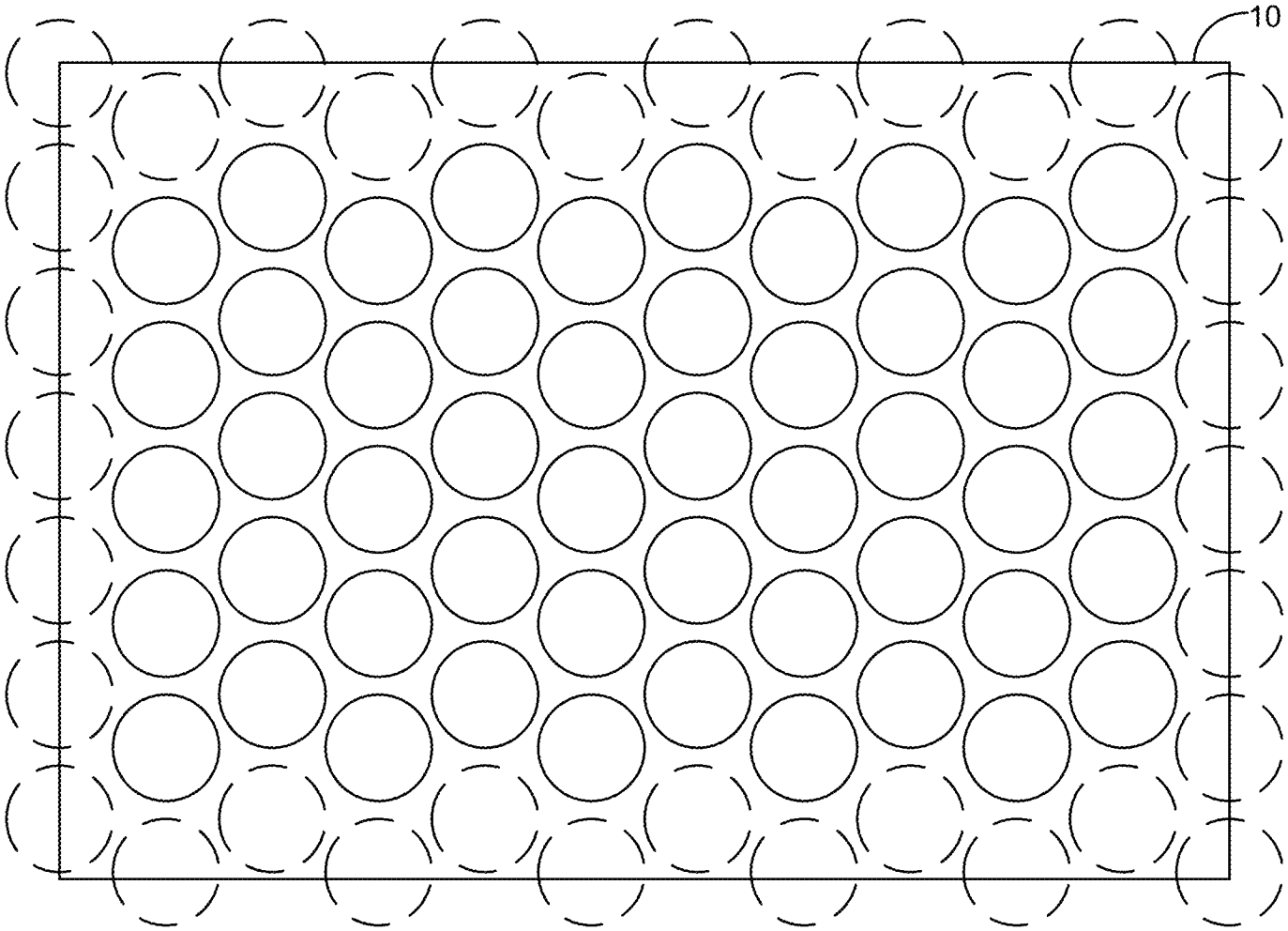
FIG. 7 is a top view of the induction cooktop of FIG. 1 showing dummy coils with zero coverage factor added around the existing coiled grid.

In FIG. 5, the graphed surface with two peaks is a 3D representation of the coverage factor matrix. The hatched horizontal plane is used for intersecting the 3D surface at a predefined intercept level. The thick black lines are the resultant intersection. The algorithm calculates the iso-level curves along the triangular grid that connects the center of adjacent coils $\mathbf{20}_1$-$\mathbf{20}_n$, as shown in FIG. 6. The vertices of the grid are placed at the centers of the coils $\mathbf{20}_1$-$\mathbf{20}_n$. Dummy coils with zero coverage factor are added around the existing coiled grid, as shown in FIG. 7, in order to always have closed curves for each cookware item 30 and 32, even the ones that lie near the border of the coil arrangement. The actual coils $\mathbf{20}_1$-$\mathbf{20}_n$ are represented by circles with black, solid borders. The coil arrangement is the same as shown in FIG. 1. The additional dummy coils are represented by circles with dashed borders.

The iso-level curve calculation starts from either a predefined value or from the maximum value in the coverage factor matrix and is then repeated multiple times, each time decreasing the intercept level by a predetermined amount, for example, 1 percentage point. Thus, referring back to FIG. 4, the method 200 next finds the maximum value in the coverage factor matrix in step 204, and sets the present intercept level (the level where the intersecting plane is located) at the identified maximum coverage value in step 206. The method then calculates the iso-level curves corresponding to the present intercept level in step 208. The algorithm counts how many closed curves have been identified for the present level in step 210. As mentioned above the intercept level is then decreased by a predetermined amount in step 212. Then, in step 214, the isolevel curves are calculated for the decreased intercept level and the number of closed iso-level curves is then determined by counting in step 216.

Each closed curve corresponds to a different cookware item 30 and 32, provided the coverage factor of the coils $\mathbf{20}_1$-$\mathbf{20}_n$ it overlies spans the selected intercept level. An example of the obtained closed curves are shown in FIGS. 8A and 9A for two different levels as shown in FIGS. 8 and 9. More specifically, FIGS. 8A and 9A show the isolevel curves obtained with the calculations shown in FIGS. 8 and 9, respectively. FIGS. 8 and 8A represent an example of iso-level curves for an intercept level selection that is too high compared to FIGS. 9 and 9A, where the intersecting plane in FIG. 8 is placed at a higher level, so the lower peak is not intersected.

When decreasing the intercept level, at a certain point, the iso-level curves that were previously distinct will be merged into a single closed curve, as shown in FIGS. 10 and 10A. Compared to FIGS. 9 and 9A, the intersecting plane is placed at a lower level, so the two peaks are merged into a single closed curve. This means that, at that intercept level, it is no longer possible to detect two distinct, but neighboring cookware items 30 and 32 as being actually separated. Thus, the intercept level selection is too low. The optimal intercept level for cookware item separation is therefore the one immediately before the one where the curves have merged.

To identify the optimum level, step 218 (FIG. 4A) of the method 200 compares the number of closed curves counted in step 216 to the number of closed curves counted at the previous intercept level. If the number of closed curves is the same or higher, then in step 220, the previously saved result is discarded and updated with the decreased intercept level determined in step 212. Then, in step 222, determine if the decreased intercept level has reached a predetermined minimum threshold X. If the decreased intercept level has not reached a predetermined minimum threshold X, steps 212-222 are repeated until either the number of closed curves counted in step 216 is lower than that previously counted or the present intercept level reaches or falls below the predetermined minimum threshold X. If the number of closed curves is determined to be lower in step 218, the method 200 keeps the previously saved result, which represents the optimum intercept level.

Using this method 200, for the curves shown in FIGS. 8A, 9A, and 10A, for example, the present level is set to the top of the highest peak and then repeatedly decreased to initially identify one closed curve as shown in FIG. 8A. The intercept level is further decreased until two curves are counted (FIG. 9A). Each time steps 212-222 are repeated, the last intercept level is saved as the saved result (step 220). Then, the intercept level is decreased even further and eventually the number of counted closed curves falls back to one (FIG. 10A). At this point, a determination is made in step 218 that the count is lower and the previous intercept level is kept as the saved result as this is the optimum intercept level.

Figure 11:
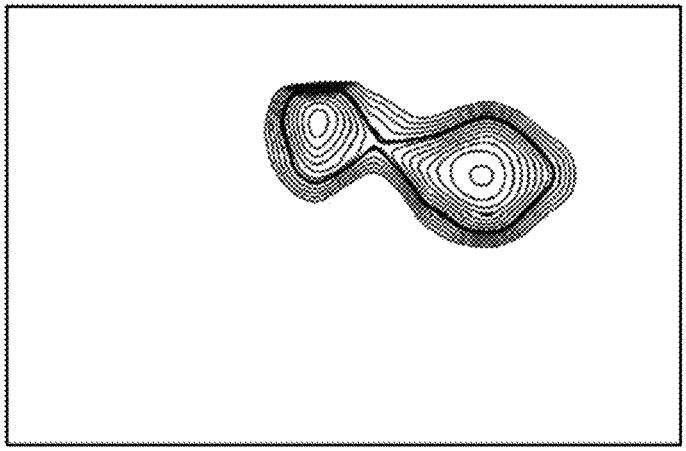
FIG. 11 is a representation of a plurality of closed curves determined from intersection of the 3D coverage factor curve of FIG. 8 by a plane at various levels.
Figure 12:
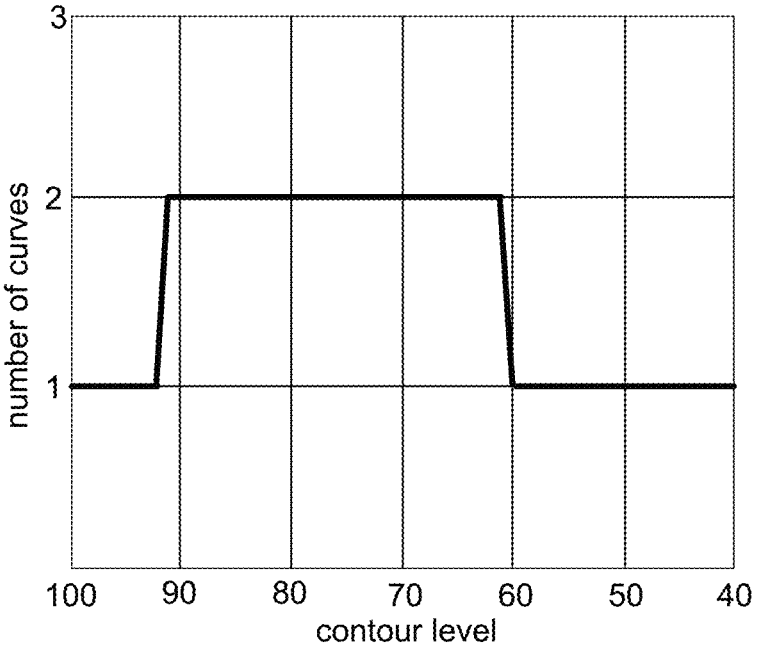
FIG. 12 is a graph of the number of closed curves versus level value.

A family of curves, corresponding to different intercept levels, is shown in FIG. 11. The thicker line indicates the lowest level for which there are two closed curves instead of one. FIG. 12 shows the corresponding number of closed curves, for each intercept level. The number of closed curves starts from 1 at level 100, since only the taller peak is detected; increases to 2 at level 92, indicating that both peaks are detected; and goes back to 1 at level 60, since the two peaks are now merged. Looking at this plot, the optimal level selection is the one immediately to the left of the decrease, in this case 61.

Figure 13:
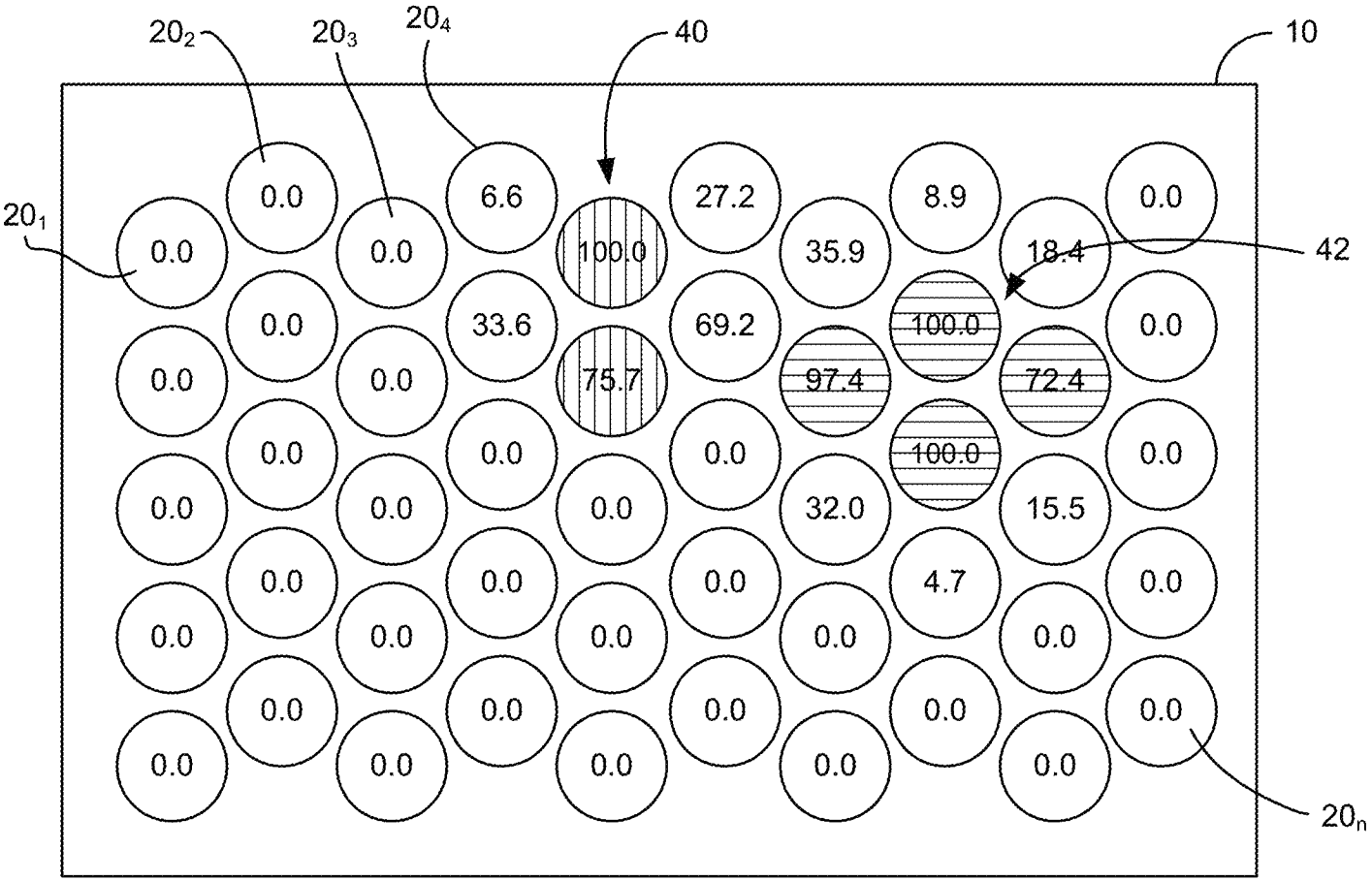
FIG. 13 is a top view of the induction cooktop of FIG. 1 shown with the coil clusters.

When the optimal level has been determined in step 224, the algorithm proceeds to determine, for each closed curve, which of the coils $\mathbf{20}_1$-$\mathbf{20}_n$ are inside the curve in step 226. One possible criteria to determine whether each coil is inside a closed curve or not, is to check whether the center of said coil is inside the curve. Another criteria is to measure the area of intersection of the closed curve and said coil, and check whether said area is greater than a predetermined threshold. These coils are grouped and assigned to distinct clusters 40 and 42 in FIG. 13. Each coil cluster 40 and 42 corresponds to one of the cookware items 30 and 32 placed on the induction cooktop 10, indicated by the thick-bordered circles. Each cluster of coil clusters 40 and 42 is used to identify the cookware items 30 and 32; in particular, it is used to estimate the center position, the shape, the size, and the orientation in step 228.

Figure 14:
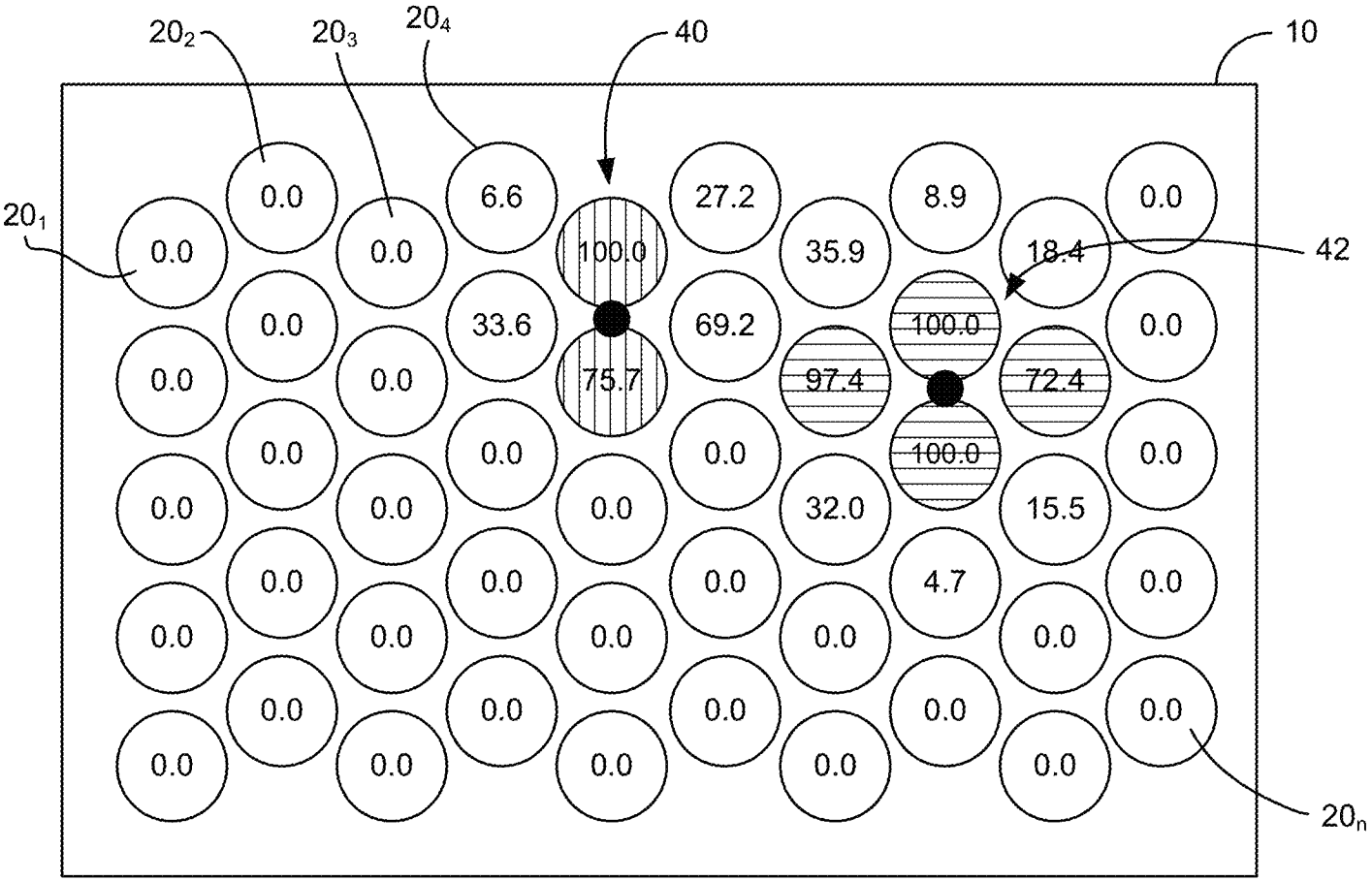
FIG. 14 is a top view of the induction cooktop of FIG. 1 shown with centroids of the coil clusters identified.

For each cluster, the centroid is identified by calculating the weighted sum of the coordinates of the centers of all the coils belonging to said cluster, wherein the weights are the coverage factors of each coil:

$$x_0 = \frac{\sum_{i=1}^{N} x_i \cdot c_i}{\sum_{i=1}^{N} c_i}, \quad y_0 = \frac{\sum_{i=1}^{N} y_i \cdot c_i}{\sum_{i=1}^{N} c_i}$$

where $x_0$, $y_0$ are the coordinates of the centroid, N is the number of coils considered in the calculation for this particular centroid, i.e. the number of coils belonging to the cluster, $x_i$, $y_i$ are the coordinates of the ith coil, and $c_i$ the coverage factor for the ith coil. The centroid coordinates calculated here are used as the estimation for the center position of the corresponding cookware item, as shown in FIG. 14.

In order to estimate the size of each cookware item, one possible way is to first calculate the weighted area of the corresponding cluster. One possible way of performing this calculation is to sum the areas of all coils belonging to the cluster, adjusted by a factor the takes into account the empty areas between coils, weighted by the corresponding coverage factors:

$$A_{cluster} = \sum_{i=1}^{N} K \cdot A_{coil} \cdot c_i$$

where $A_{cluster}$ is the area estimation for the cluster, N is the number of coils belonging to the cluster, K is an adjusting factor, $A_{coil}$ is the area of the ith coil, and $c_i$ is the coverage factor for the ith coil. The information on the area of the cluster can be used to estimate the radius of the cookware item, in case the cookware item is circular:

$$r = \sqrt{\frac{A_{cluster}}{\pi}}$$

where r is the estimation for the radius of the cookware item, and $A_{cluster}$ is the area estimation for the cluster just calculated.

Another possible way to estimate the size of each cookware item, is first calculate the second moments of area and the product of inertia. One possible way of performing this calculation is to consider cartesian axes, passing through the center of the cookware item, and parallel to the axes of the reference coordinate system defined in § 0045. The moments can be calculated as:

$$I_{xx} = \sum_{i=1}^{N} c_i \cdot \left[I_{x_{coil}} + A_{coil}(y_{c_i} - y_0)^2\right]$$

$$I_{yy} = \sum_{i=1}^{N} c_i \cdot \left[I_{y_{coil}} + A_{coil}(x_{c_i} - x_0)^2\right]$$

$$I_{xy} = \sum_{i=1}^{N} c_i \cdot \left[I_{xy_{coil}} + A_{coil}(x_{c_i} - x_0)(y_{c_i} - y_0)\right]$$

where $I_{xx}$ is the second moment of area relative to the x-axis, $I_{yy}$ is the second moment of area relative to the y-axis, and $I_{xy}$ is equivalent to the product of inertia; $I_{xcoil}$ is the second moment of area for the coils shape relative to the x-axis, $I_{ycoil}$ is the second moment of area for the coil shape relative to the y-axis, and $I_{xycoil}$ is the equivalent to the product of inertia for the coils shape; $A_{coil}$ is the area of each coil, $x_{ci}$ is the x coordinate for the center of the ith coil, and $y_{ci}$ is they coordinate for the center of the ith coil, $x_0$ is the x coordinate for the estimated center of the cookware item, $y_0$ is the y coordinate for the estimated center of the cookware item, and $c_i$ is the coverage factor for the ith coil.

Next step is to calculate the principal moments and the angle of rotation; the principal moments are oriented along the main directions of the shape, and can be calculated as:

$$I_{I,II} = \frac{I_{xx} + I_{yy}}{2} \pm \sqrt{\left(\frac{I_{xx} - I_{yy}}{2}\right)^2 + I_{xy}^2}$$

$$\theta = \frac{1}{2}\arctan\left(-\frac{2I_{xy}}{I_{xx} - I_{yy}}\right)$$

where $I_I$ and $I_{II}$ are the principal moments, and θ is the rotation angle of the cookware item relative to the axes of the reference coordinate system.

Finally, using the calculated principal moments, it is possible to estimate the major and minor semiaxes of the cookware item, in case the cookware item is elliptical:

$$a = \sqrt[4]{\frac{4}{\pi} I_I \sqrt{\frac{I_I}{I_{II}}}}$$

$$b = \sqrt[4]{\frac{4}{\pi} I_{II} \sqrt{\frac{I_{II}}{I_I}}}$$

where a is the major semiaxis and b is the minor semiaxis of the cookware item.

A typical method to estimate the shape is to consider the ratio between the two semiaxes a and b just calculated: if the two values of a and b are the same, the ratio is 1 and the shape is circular; if they are different, the ratio is other than 1 and the shape is elliptical. Due to the uncertainty in the estimation and calculation of the values of the major and minor semiaxes, it is typical to compare the ratio/with a predefined threshold, and if the ratio is larger than this threshold consider the shape as elliptical, whereas if the ratio is smaller than this threshold the shape is considered as circular.

For efficiency reasons, it is advantageous to limit this process to coils whose coverage factors is higher than a predefined threshold, since coils with a small coverage factor would have a negligible contribution either to the identification of the position, shape, size, and orientation of a cookware item, or to the heating of the cookware item itself.

Figure 15:
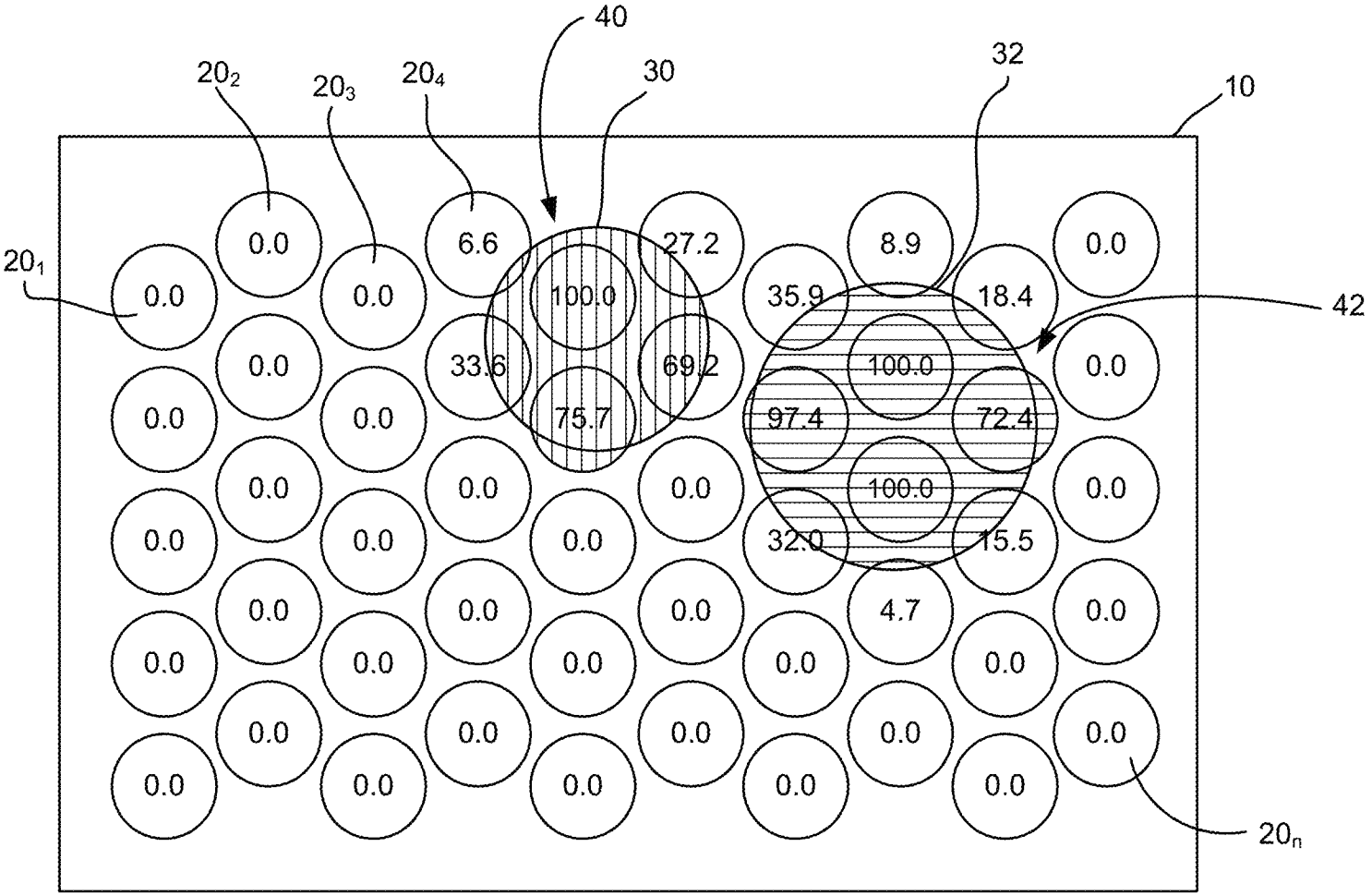
FIG. 15 is a top view of the induction cooktop of FIG. 1 shown with the coil clusters and the corresponding estimation of the cookware items.

FIG. 15 finally shows the coil clusters with the corresponding estimated cookware items.

Figure 16:
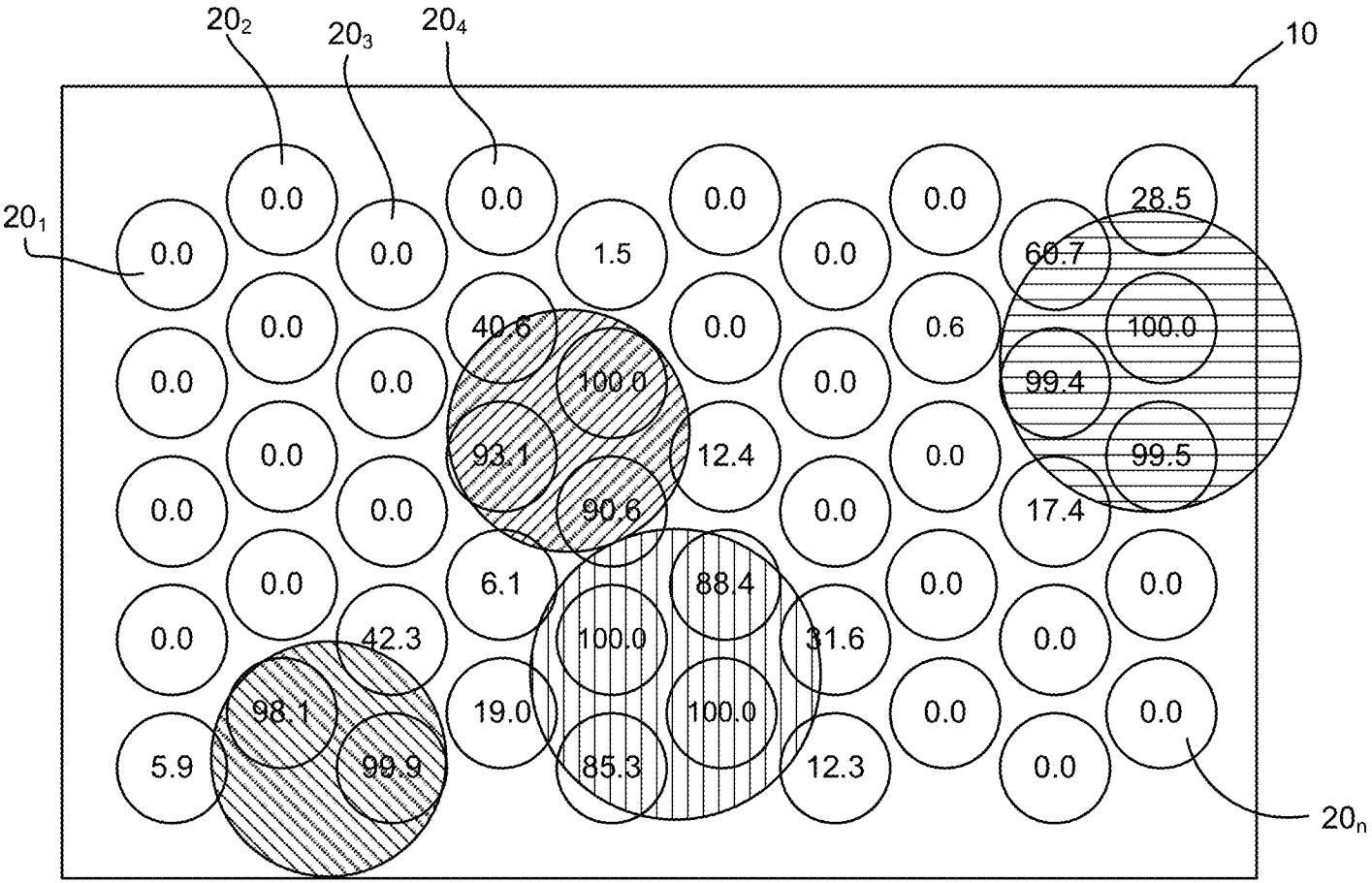
FIG. 16 is a top view of the induction cooktop of FIG. 1 shown with four cookware items thereon with the coverage factors of each coil indicated.

In the following paragraphs, another example of the method operation is detailed, applied to the pots placed on top of the cooktop as shown in FIG. 16. FIG. 16 shows four pots placed on the cooktop, in particular two of the pots are actually touching each other.

Figure 17:
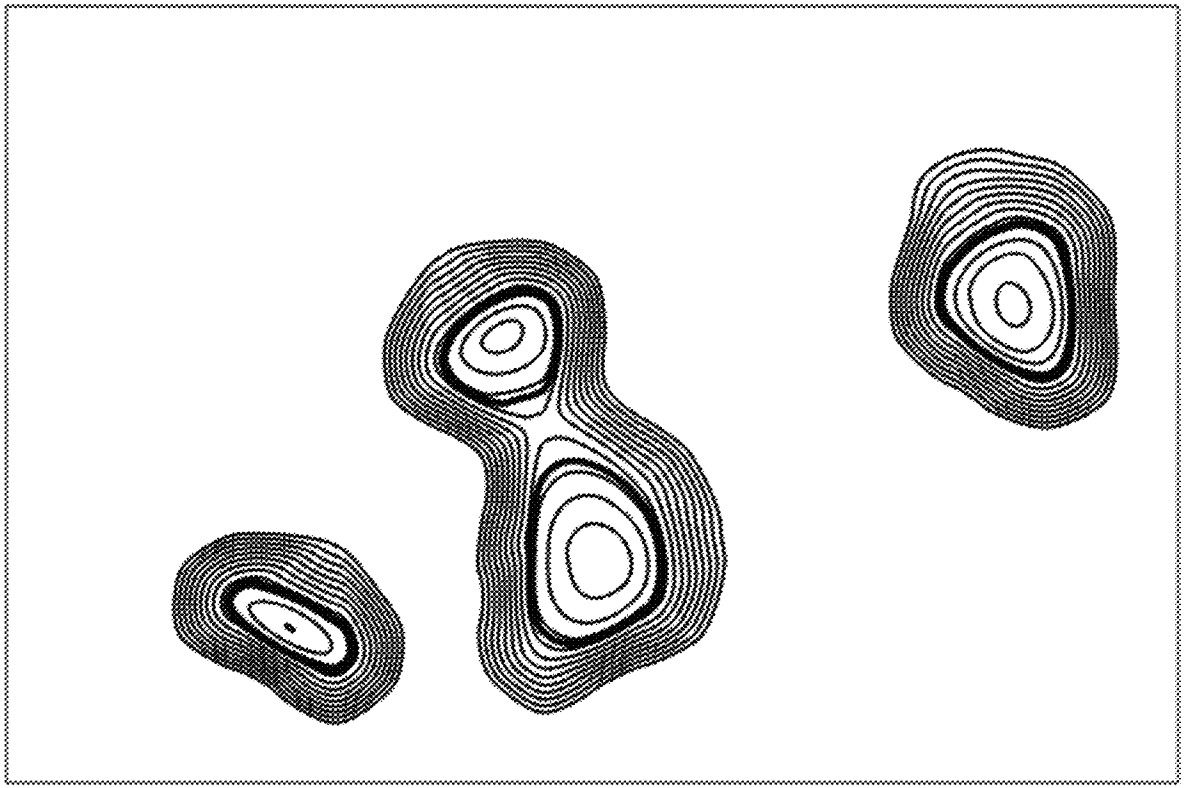
FIG. 17 is a representation of a plurality of closed curves determined from intersection of the 3D coverage factor curve by a plane at various levels.

FIG. 17 shows the different families of iso-level curves, obtained by the intersection of the 3D coverage factor curve with a plane at various levels.

Figure 18:
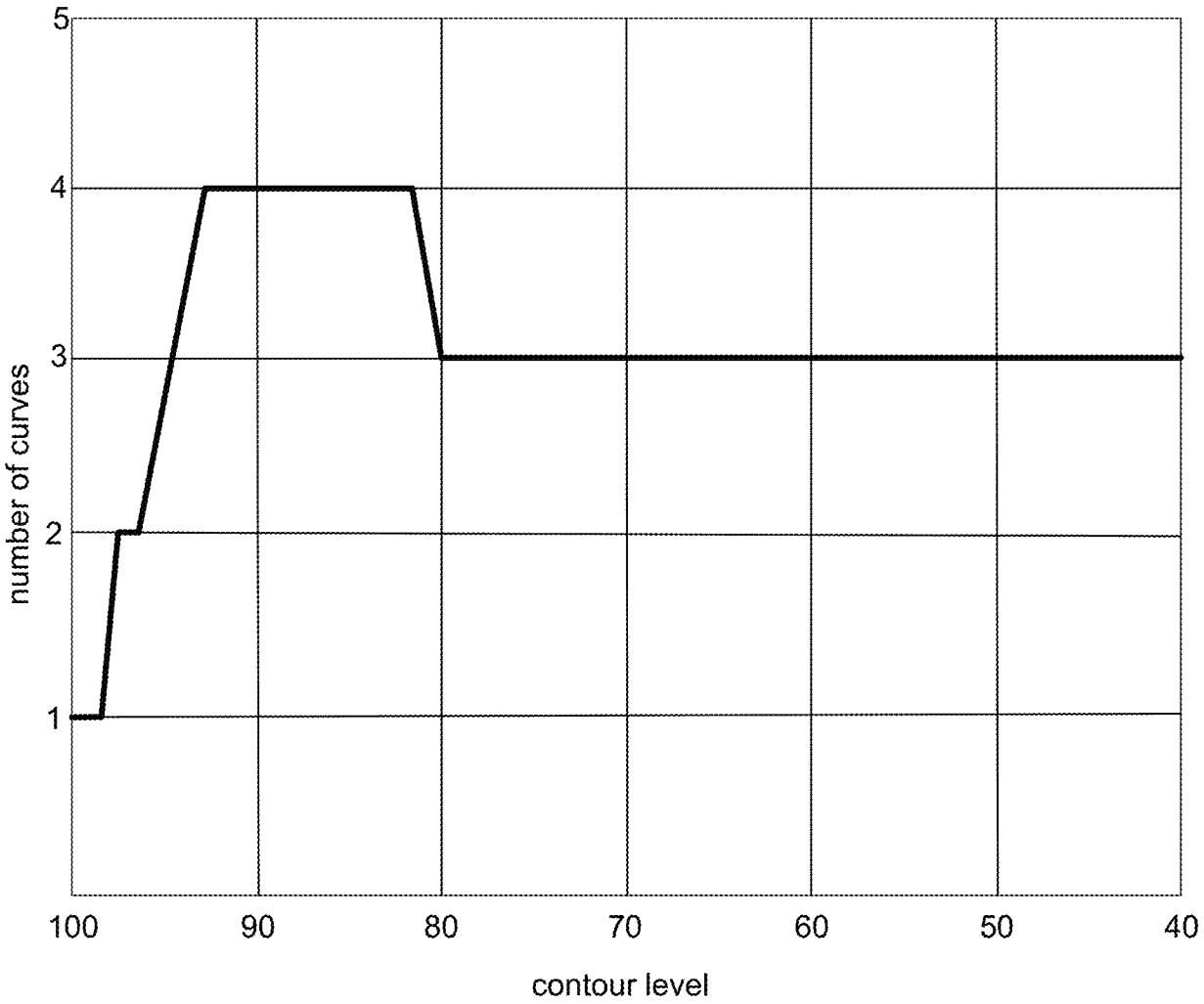
FIG. 18 is a graph of the number of closed curves versus level value.

FIG. 18 shows the number of closed curves versus level value, for the families of curves shown in FIG. 17. In this particular example, the first level value for which there is a decrease in the number of closed curves is 80, so the correct level value to consider for the continuation of the method is 81.

FIGS. 19 and 19A show the 3D surface derived from the coverage factor, and the corresponding isolevel curves obtained by setting the level 81.

Figure 20:
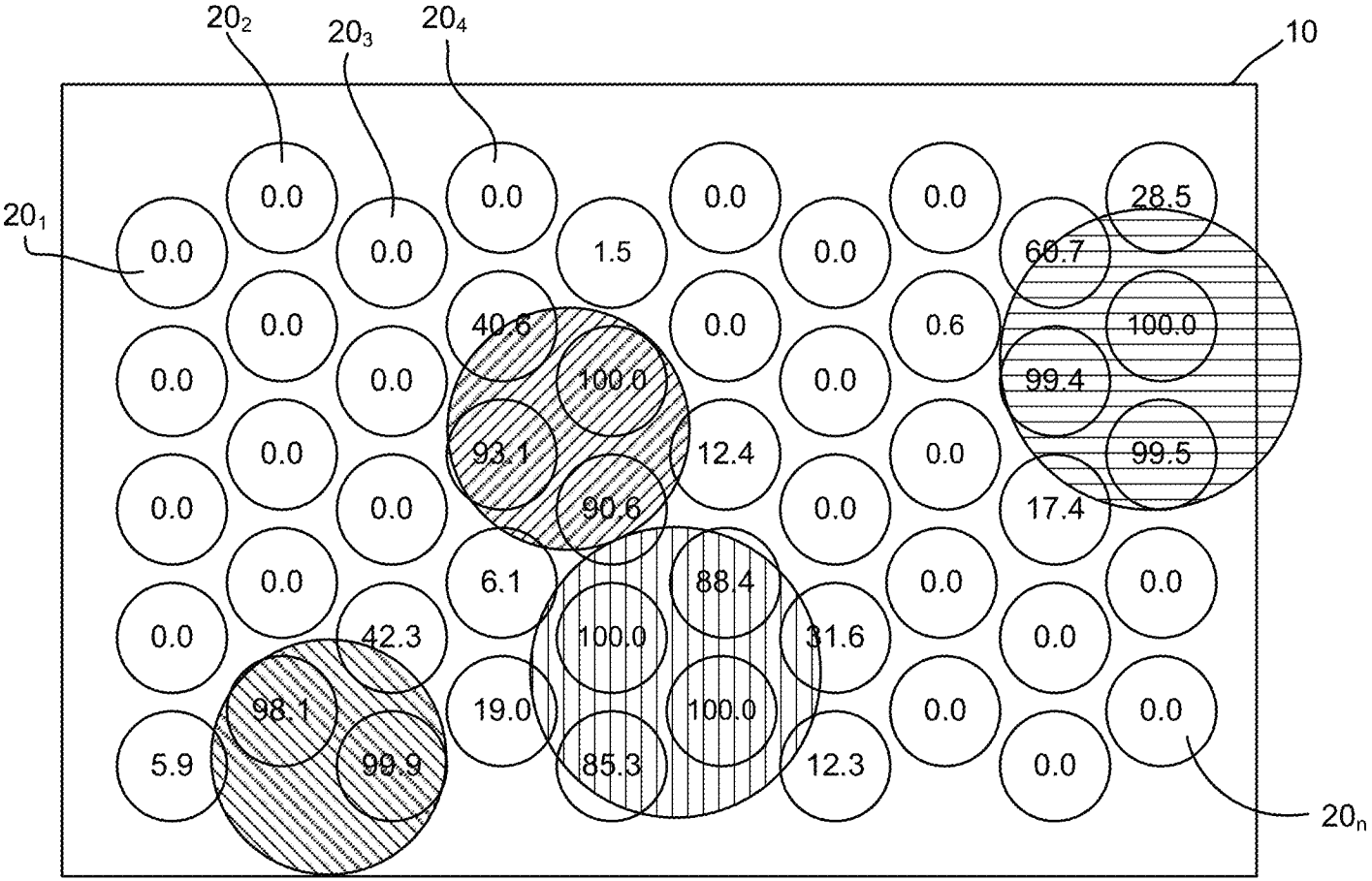
FIG. 20 is a top view of the induction cooktop of FIG. 1 shown with the coil clusters and the corresponding estimation of the cookware items.

FIG. 20 finally shows the coil clusters, as determined in FIGS. 19 and 19A, with the corresponding estimated cookware items.

Once the geometrical characteristics of the cookware item have been estimated, namely center position, shape, size, and orientation, the system can use this information to display a visual representation of the cookware items on the User Interface 104.

The user can then select a first power level input for at least one of the identified cookware items, said first power level input being set by a user through a user interface 104, or any other means.

The system will then assign a second power level to each coil belonging to a cluster derived from the first power level input received from the user, said second power level being determined and set by the controller; this second power level can be set in many different ways. A non-limiting example is to divide the first power level equally among all the coils belonging to the cluster, for example if the first power level is 1200 W and the cluster is composed of 6 coils, the second power level for each coil would be 200 W. Another non-limiting example would be to determine the second power level proportionally to the coverage factor. Other criteria are easily determinable by people skilled in the art.

Finally, the system will control the power delivery to the coils belonging to the identified coil cluster corresponding to the selected cookware item, in order to deliver the first power level requested by the user to the selected cookware item.

Compared to known solutions, clustering of coils allows to discriminate between adjacent cookware items directly, with no need to further process an area previously identified as it happens e.g. in the case of EP2242328 and EP2112865.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A method of identifying cookware items placed on top of an induction cooktop having a plurality of coils, comprising the following steps:

(a) acquire coverage factor information for each coil, and collect it into a coverage factor matrix;

(b) set a present intercept level at a predetermined starting value;

(c) calculate iso-level curves corresponding to the present intercept level;

(d) count the number of closed iso-level curves calculated in step (c) and save the result;

(e) decrease the intercept level by a predetermined amount;

(f) calculate iso-level curves corresponding to the decreased intercept level;

(g) count the number of closed iso-level curves calculated in step (f);

(h) compare the number of closed curves at the present intercept level with the number of closed curves from the previous intercept level;

(i) if the number of closed curves at the present intercept level is the same as or higher than the number of closed curves from the previous intercept level, discard the previously saved result and update with the present intercept level;

(j) if the number of closed curves at the present intercept level is lower than the number of closed curves from the previous intercept level, keep the previously saved result and skip to step (l);

(k) repeat steps (e) to (k), until the number of closed curves at the current intercept level is lower than the number of closed curves from the previous intercept level or the decreased intercept level reaches a predetermined minimum threshold;

(l) for each closed curve, determine which coils are inside the curve, and assign those coils to a distinct cluster; and (m) use the distinct cluster(s) to estimate a position, shape, size, and orientation of the cookware item.

2. The method of claim 1, wherein step (c) includes calculating a 3D representation of the coverage factor matrix.

3. The method of claim 2, wherein step (c) further includes selecting an intersecting plane at the present intercept level and forming iso-level curves from the points of intersection of the 3D representation and the intersecting plane.

4. The method of claim 3, wherein the intersecting plane is a horizontal plane.

5. The method of claim 1, and further comprising the step of (n) supplying power to the coils underlying the cookware items.

6. The method of claim 2, wherein when plotting the 3D representation of the coverage factor matrix, dummy coils are generated about the periphery of the actual coils, wherein the dummy coils have a coverage factor of zero.

7. The method of claim 1, wherein the predetermined starting value is a maximum value in the coverage factor matrix.

8. The method of claim 1, wherein the determination in step (l) of which coils are inside the curve is based on whether the center of said coil is inside the curve.

9. The method of claim 1, wherein the determination in step (l) of which coils are inside the curve is based on whether the area of intersection of the closed curve and said coil is greater than a predetermined threshold.

10. An induction cooktop system comprising:

an induction cooktop including a plurality of induction coils;

a power supply for supplying power to selected ones of the plurality of induction coils; and a controller for identifying cookware items placed on top of the induction cooktop, estimating the position, shape, size, and orientation of the cookware items, and controlling the amount of power supplied to the selected ones of the plurality of induction coils, the controller being programmed to perform at least the following steps:

(a) acquire coverage factor information for each coil, and collect it into a coverage factor matrix;

(b) set a present intercept level at the identified maximum value;

(c) calculate iso-level curves corresponding to the present intercept level;

(d) count the number of closed iso-level curves calculated in step (c) and save the result;

(e) decrease the present intercept level by a predetermined amount;

(f) calculate iso-level curves corresponding to the decreased intercept level;

(g) count the number of closed iso-level curves calculated in step (f);

(h) compare the number of closed curves at the present intercept level with the number of closed curves from the previous intercept level;

(i) if the number of closed curves at the present intercept level is the same as or higher than the number of closed curves from the previous intercept level, discard the previously saved result and update with the present intercept level;

(j) if the number of closed curves at the present intercept level is lower than the number of closed curves from the previous intercept level, keep the previously saved result and skip to step (l);

(k) repeat steps (e) to (k), until the number of closed curves at the current intercept level is lower than the number of closed curves from the previous intercept level or the decreased intercept level reaches a predetermined minimum threshold;

(l) for each closed curve, determine which coils are inside the curve, and assign those coils to a distinct cluster; and (m) use the distinct cluster(s) to estimate a position, shape, size, and orientation of the cookware item.

11. The system of claim 10, wherein step (c) includes calculating a 3D representation of the coverage factor matrix.

12. The system of claim 11, wherein step (c) further includes selecting an intersecting plane at the present intercept level and forming iso-level curves from the points of intersection of the 3D representation and the intersecting plane.

13. The system of claim 12, wherein the intersecting plane is a horizontal plane.

14. The system of claim 10, and further comprising the step of (n) supplying power to the coils underlying the cookware items.

15. The system of claim 11, wherein when calculating the 3D representation of the coverage factor matrix, dummy coils are generated about the periphery of the actual coils, wherein the dummy coils have a coverage factor of zero.

16. The system of claim 10, wherein the predetermined starting value is a maximum value in the coverage factor matrix.

17. The system of claim 10, and further comprising a user interface coupled to the controller for providing user input to the controller.

18. The system of claim 10, wherein the determination in step (l) of which coils are inside the curve is based on whether the center of said coil is inside the curve.

19. The system of claim 10, wherein the determination in step (l) of which coils are inside the curve is based on whether the area of intersection of the closed curve and said coil is greater than a predetermined threshold.

20. A method of identifying cookware items placed on top of an induction cooktop having a plurality of coils, comprising the following steps:

(a) acquire coverage factor information for each coil, and collect it into a coverage factor matrix;

(b) set a present intercept level at a maximum value identified in the input coverage factor matrix;

(c) identify and count closed iso-level curves corresponding to the present intercept level and save the result;

(d) decrease the present intercept level by a predetermined amount;

(e) identify and count closed iso-level curves corresponding to the decreased intercept level;

(f) when the number of closed curves at the present intercept level is the same as or higher than the number of closed curves from the previous intercept level, discard the previously saved result and update with the present level;

(g) when the number of closed curves at the present intercept level is lower than the number of closed curves from the previous intercept level, keep the previously saved result and skip to step (i);

(h) repeat steps (d) to (h), until the number of closed curves at the current intercept level is lower than the number of closed curves from the previous intercept level or the decreased intercept level reaches a predetermined minimum threshold;

(i) for each closed curve, determine which coils are inside the curve, and assign those coils to a distinct cluster;

(j) use the distinct cluster(s) to estimate a position, shape, size, and orientation of the cookware item; and (k) supply power to the coils underlying the cookware items.

21. The method of claim 20, wherein step (c) includes calculating a 3D representation of the coverage factor matrix.

22. The method of claim 21, wherein step (c) further includes selecting an intersecting plane at the present intercept level and forming iso-level curves from the points of intersection of the 3D representation and the intersecting plane.

23. The method of claim 20, wherein the intersecting plane is a horizontal plane.

24. The method of claim 20, wherein the determination in step (i) of which coils are inside the curve is based on whether the center of said coil is inside the curve.

25. The method of claim 20, wherein the determination in step (i) of which coils are inside the curve is based on whether the area of intersection of the closed curve and said coil is greater than a predetermined threshold.

* * * * *